US006377169B1

(12) United States Patent
Yanagisawa

(10) Patent No.: US 6,377,169 B1
(45) Date of Patent: Apr. 23, 2002

(54) TRANSMITTED SIGNAL CONFIRMATION DEVICE, VEHICULAR TRANSMITTED SIGNAL CONFIRMATION DEVICE AND CONFIRMATION METHOD OF TRANSMITTED SIGNAL

(75) Inventor: Takashi Yanagisawa, Toyota (JP)

(73) Assignee: Toyota Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 09/219,171

(22) Filed: Dec. 22, 1998

(30) Foreign Application Priority Data

Dec. 26, 1997 (JP) ..... 9-359078

(51) Int. Cl.[7] ..... G08B 23/00

(52) U.S. Cl. ..... 340/504; 340/506; 340/825.06; 340/505; 340/531

(58) Field of Search ..... 340/502, 504, 340/298, 313, 314, 505, 506, 533, 531, 825.06, 825.07, 825.08, 825.29

(56) References Cited

U.S. PATENT DOCUMENTS 4,616,214 A * 10/1986 Naito ..... 340/533
5,557,254 A * 9/1996 Johnson et al. ..... 340/426

FOREIGN PATENT DOCUMENTS

| | | |
|---|---|---|
| JP | 56-147530 | 11/1981 |
| JP | 59-68100 | 4/1984 |
| JP | 01-206756 | 8/1989 |
| JP | 06-20192 | 1/1994 |
| JP | 06-251292 | 9/1994 |
| JP | 8-273075 A | 10/1996 |

* cited by examiner

*Primary Examiner*—Daryl Pope
(74) *Attorney, Agent, or Firm*—Burns, Doane, Swecker & Mathis, LLP

(57) ABSTRACT

A transmitted signal confirmation device includes a transmitter, a receiver, a situation detecting device, an indicating mode determining device, and an indicator. The transmitter transmits the signal of a location of an individual (e.g., a vehicle). The receiver receives a signal receipt confirmation signal from a distant facility indicating receipt of the transmitted signal. The situation detecting device detects the situation existing at the location. The indicating mode determining device selects one indicating mode out of plural different indicating modes based on the situation at the location. The indicator provides a signal receipt confirmation indication with the one indicating mode when the receiver has received the confirmation signal.

26 Claims, 7 Drawing Sheets

TRANSMITTED SIGNAL CONFIRMATION DEVICE, VEHICULAR TRANSMITTED SIGNAL CONFIRMATION DEVICE AND CONFIRMATION METHOD OF TRANSMITTED SIGNAL

This application is based on and claims priority under 35 U.S.C. §119 with respect to Japanese Application No. 9-359078 filed on Dec. 26, 1997, the entire content of which is incorporated herein by reference.

FIELD OF THE INVENTION

The present invention relates to a transmitted signal confirmation device. More particularly, the present invention relates to a device which transmits a signal to a remote location indicating an individual's situation, with the remote location returning a signal receipt confirmation signal indicating receipt of the transmitted signal.

BACKGROUND OF THE INVENTION

An individual that is at home or in a vehicle is somewhat isolated from the outside, but is nevertheless in need of communicating with the outside. For example, when the individual is sick, has been involved in an accident, or is otherwise in need of help, particularly emergency help, it is desirable that the individual be able to transmit a signal, particularly an emergency signal, to the outside, for example to a control center which receives and acts on the signal. In such a situation, it would be desirable for the individual to receive confirmation of receipt of the transmitted signal by the control center.

Japanese Laid-Open Publication No. 1-206756 discloses a system for confirming receipt of a transmitted signal. A centrally located management system which is managed by the control center provides a confirmation indicating signal (a transmitted signal received sign) to notify the user that the signal has been received. The confirmation indicating signal is provided when the transmitted signal has been received.

According to the system described in the above-identified document, however, the indicator has only one confirmation indicating mode. Thus, the confirmation indicating signal is recognizable even in situations where recognition of the confirmation indication signal is not desired. For example, it is desirable that the individual be capable of reliably recognizing the confirmation indicating signal when the individual is sick or has been involved in an accident. However, in an emergency situation such as when a robber enters a vehicle, when the individual sends an emergency signal, the confirmation indication signal should preferably not be easily recognized because the robber will then be aware that an emergency signal has been sent.

Accordingly, a need exists for a transmitted signal confirmation device which provides different confirmation signals depending upon the conditions associated with the transmitted signal.

SUMMARY OF THE INVENTION

According to one aspect of the invention, a transmitted signal confirmation device includes a transmitter for transmitting a signal indicating a location, a receiver for receiving a signal receipt confirmation signal transmitted by a facility remote from the location indicating that the facility has received the signal transmitted by the transmitter, an indicating mode determining mechanism for determining one indicating mode out of a plurality of different indicating modes based on the signal receipt confirmation signal received by the receiver, and an indicator for providing a signal receipt confirmation indication based on the indicating mode determined by the indicating mode determining mechanism.

According to another aspect of the invention, a vehicular transmitted signal confirmation device includes a transmitter for transmitting a signal indicating a location of a vehicle, a receiver for receiving a signal receipt confirmation signal transmitted by a facility outside the location indicating that the facility has received the signal transmitted by the transmitter, a situation detecting device for detecting a situation existing at the location, an indicating mode determining device for determining one indicating mode from a plurality of different indicating modes based on the situation existing at the location as detected by the situation detecting device, and an indicator for providing a signal receipt confirmation indication with the one indicating mode when the receiver has received the signal receipt confirmation signal.

Another aspect of the invention involves a method of confirming receipt of a transmitted signal that includes transmitting a signal indicating a location, receiving a signal receipt confirmation signal indicating that a facility outside the location has received the transmittal signal, selecting one indicating mode out of plural different indicating modes based on the transmitted signal, and providing a signal receipt confirmation indication based on the one indicating mode.

BRIEF DESCRIPTION OF THE DRAWING FIGURES

The novel features of the present invention are set forth with particularity in the appended claims. The invention, together with the objects and advantages thereof, may best be understood by reference to the following description of the referred embodiments together with the accompanying drawings in which;

DETAILED DESCRIPTION OF THE PREFERRED EMBODIMENTS

Figure 1:
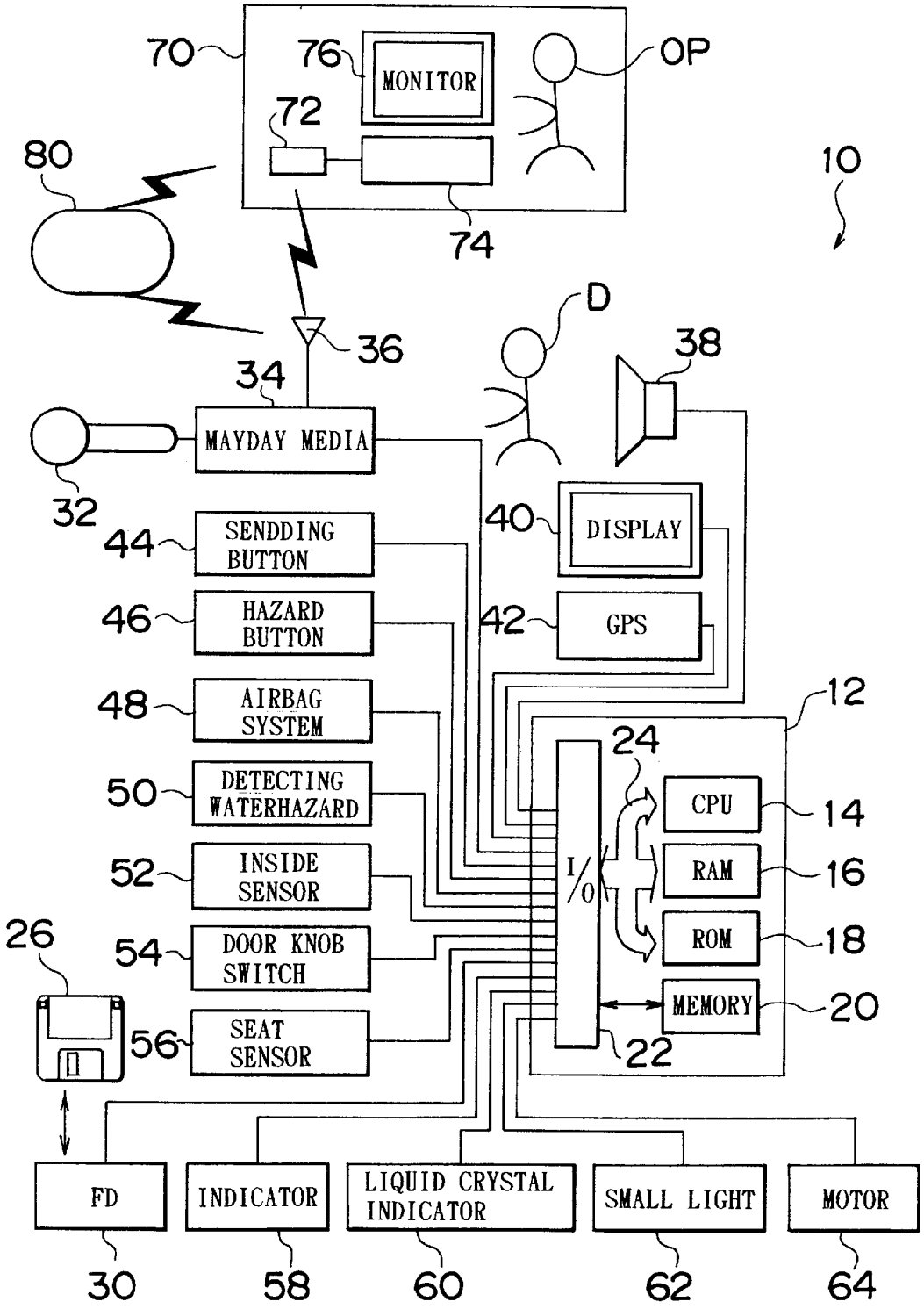
FIG. 1 is a schematic illustration of a transmitted signal confirmation device in accordance with the present invention.

FIG. 1 illustrates a system or navigation system according to an embodiment of the present invention that is adapted to offer the user information in the form of images or sounds. With reference to FIG. 1, the system 10 includes a main unit 12, a vehicular display 40, a speaker unit 38 and a route input unit 42. The main unit 12 has a CPU (Central Processing Unit) 14, a RAM (Random Access Memory) 16, a ROM (Read Only Memory) 18, another memory 20, an I/O (Input-Output) device 22, and a bus line 24. The memory 20 is used for memorizing a driver's temporary situation. The bus line 24 connects the I/O device 22 to the CPU 14, the RAM 16, and the ROM 18. The RAM 16 works as a backup-RAM, used for memorizing information in case the battery becomes disconnected. A FD unit (Floppy Disk unit) 30 is connected to the I/O device 22 and is adapted to read a FD(Floppy Disk) 26.

The ROM 18 includes memorized process routines (described in more detail below) and information for detecting an indicating mode on the basis of the driver's situation. The process routines and the information can also be made available for rewriting in the FD 26 through the FD unit 30. Therefor, it is possible to run the process program in the FD 26 through the FD unit 30 beforehand without memorizing the ROM 18. It is also possible to run the process routines in a Large Memory Unit (for example a Hard Disk Unit) which is connected to the I/O device 22. The process routines in such a Large Memory Unit can be installed by the FD 26 through the FD unit 30. It is also possible to substitute an Optical Disk Memory (e.g. CD-ROM) and an Optical Magnetic Disk Memory (e.g. Mini Disk) for the FD 26.

This navigation system 10 illustrated in FIG. 1 can also be connected to the Vehicular Local Network though the I/O device 22.

The vehicular display 40, the speaker unit 38 and the route input unit 42 are connected to the I/O device 22. The vehicular display 40 is used for informing the driver of subsidiary route information in the form of images by way of the route input unit 42. The vehicular display 40 can also be used to inform the driver of the confirmation indication signal. The confirmation indication signal is sent by a control center 70 (described below) when the control center 70 has received the transmitted signal from the source (e.g., a vehicle). The speaker 38 is used to provide an audio mechanism for informing the driver of subsidiary route information. The audio information is derived from the driving signal which is transformed from a digital or analog signal. The route input unit 42 has a CD-ROM device (not shown) and a GPS (Global Positioning System) device.

An indicator 58, a liquid crystal indicator 60, and a seat vibration motor 64 are connected to the I/O device 22. The indicator 58 is used to provide the driver or other individual with a signal receipt confirmation indication and can be located on the instrument panel inside the vehicle. The liquid crystal indicator 60 is also used to provide the driver or other individual with a signal receipt confirmation indication and can also be located on the instrument panel. The seat vibration motor 64 vibrates the driver's seat, the passenger's seat or one of the other seats in a slight manner.

In addition, a small light 62 is also connected to the I/O device 22. The small light 62 also serves as a mechanism for providing the driver or other individual with a signal receipt confirmation indication signal. However, unlike the indicators 58, 60, the small light 62 is difficult for the driver to easily see or recognize. That is, the small light 62 is not as readily apparent as the indicators 58, 60.

Figure 2:
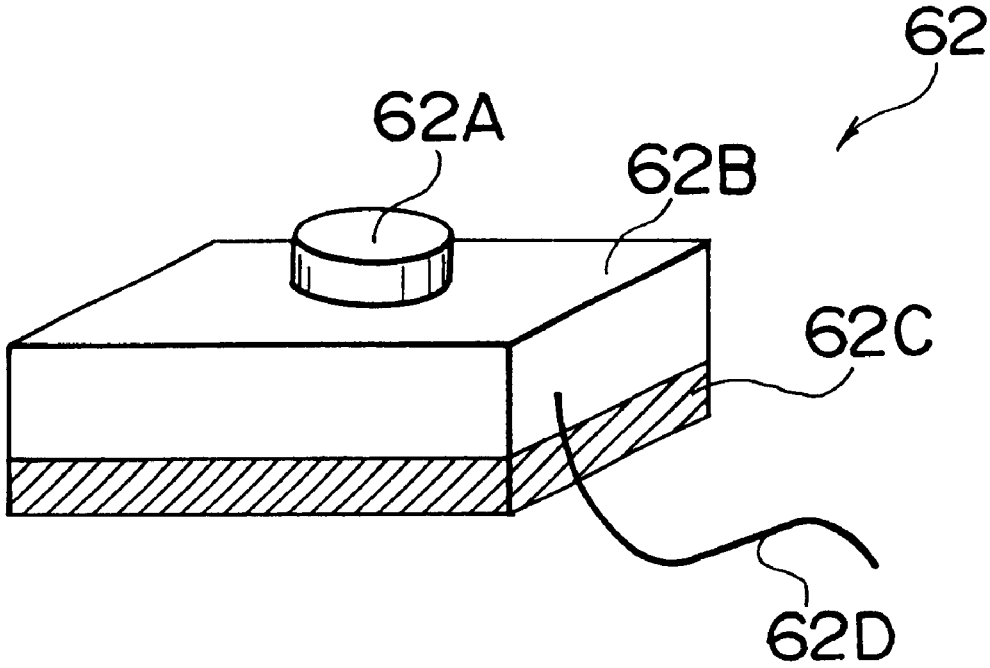
FIG. 2 is a perspective view of the small light used to indicate confirmation of the transmitted signal.

The small light 62 which is illustrated in FIG. 2 includes a light 62A, a main unit 62B, a fastening portion 62C and an electric wire 62D. The light 62A is located on one side of the main unit 62B and the fastening portion 62C is located the other side of the main unit 62B. The electric wire 62D is connected to the light 62A and protrudes from the side wall of the main unit 62B. The opposite end of the electric wire 62D is connected to the I/O device 22. The light 62A is a tiny light, for example a LED (Light Emitting Diode), and is not easily seen unless an individual knows where to look for the light 62A. The small light 62 is adapted to be fixed inside the vehicle at any desirable location by the fastening portion 62C. The fastening portion 62C can be a suitable adhesive that allows the small light 62 to be adhered to any desired place within the vehicle. Therefore, the small light 62 can be located at a place within the vehicle that is visually obscured or hidden from the outside, for example the part of the dashboard which is unable to be easily seen by a robber (e.g., at the underside of the dashboard).

As further shown in FIG. 1, a sending button 44, a hazard button 46, an air bag system 48, a detecting device for an under water situation 50, a detecting inside sensor 52, a door knob switch 54 and a seat sensor 56 are all connected to the I/O 22. The sending button 44 allows the driver or other individual to transmit an emergency signal. The hazard button 46 is used to actuate the vehicle hazard lights to provide an indication of a vehicle emergency stop. The air bag system 48 is adapted to inflate the air bag to protect the driver and sends a signal in the case of inflation of the air bag. The under water situation detecting device 50 detects an under water situation which is judged from a humidity sensor and sends a signal when the under water situation is detected. The inside detecting sensor 52 is adapted to detect the inside of the vehicle, for example through use of an image sensor, a TV camera or some touch switch. The inside detecting sensor 52 makes it possible to view the driver's situation, for example that the driver is sleeping or that a robber has entered the vehicle. It is also possible to detect the robber's entry into the vehicle by a switch which is detectable upon opening of the vehicle door or by a window breaking signal (i.e., a signal indicating that a vehicle window has been broken). The door knob switch 54 sends a signal in situations where the outside door knob of the locking door knob is pulled by someone. The seat sensor 56 sends a signal when the driver is sitting on the driver's seat.

In addition, a mayday media terminal device 34 is connected to the I/O device 22. The mayday media terminal device 34 transmits an emergency signal by radio wave and receives the signal receipt confirmation signal to inform the driver of receipt of the emergency signal. The mayday media terminal device 34 is provided with an antenna 36 and a microphone 32. The antenna 34 is used for communicating with the control center 70 or another vehicle 80. The microphone 32 is available to input the driver's voice.

According to this embodiment, the signal receipt confirmation signal transmitted by the control center 70 or another vehicle 80 is sent to the vehicular navigation system 10, but the present invention is not limited in this regard. For example, the present invention is also useful for the transmission of emergency information from a user's home by using the telephone line.

Information from the mayday media terminal device 34 is transmitted and received at the control center 70. The control center 70 includes a receiving device 72, a main receiving unit 74 and a center display 76 located at the control center 70. The main receiving unit 74 includes a micro-computer with a CPU (Central Processing Unit), and provides the driver with signal receipt confirmation information. The main receiving unit 74 can also call another vehicle 80, for example emergency service personnel or security service personnel. This other vehicle 80 receives the emergency signal and can then go to the location where the emergency has occurred or can view the driver's situation (e.g., through use of the inside detecting sensor 52).

In the control center 70, an operator OP informs the driver D or other individual by way of a signal receipt confirmation signal that the emergency signal transmitted from the vehicle or other location has been received. Based on the nature of the transmitted emergency signal, the operator OP determines which signal receipt confirmation signal to send to the driver or other individual—the signal which provides a more easily noticeable signal receipt confirmation indication or the signal which provides an obscured and less noticeable signal receipt confirmation indication. The driver is thus informed by one of the two signal confirmation indications that the transmitted emergency signal has been received by the control center 70.

Figure 3:
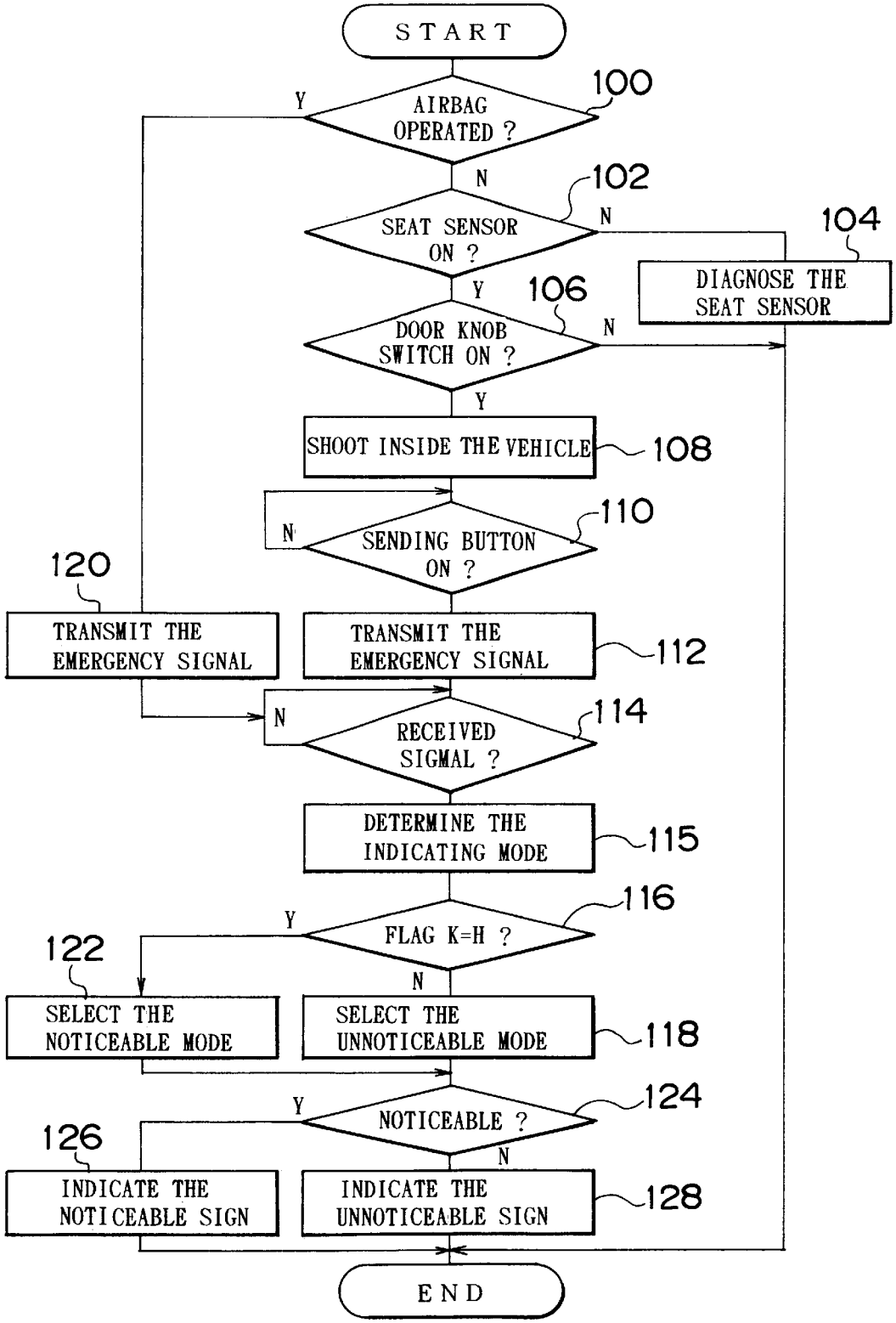
FIG. 3 is a flow chart setting forth the operational program of the transmitted signal confirmation device.
Figure 4:
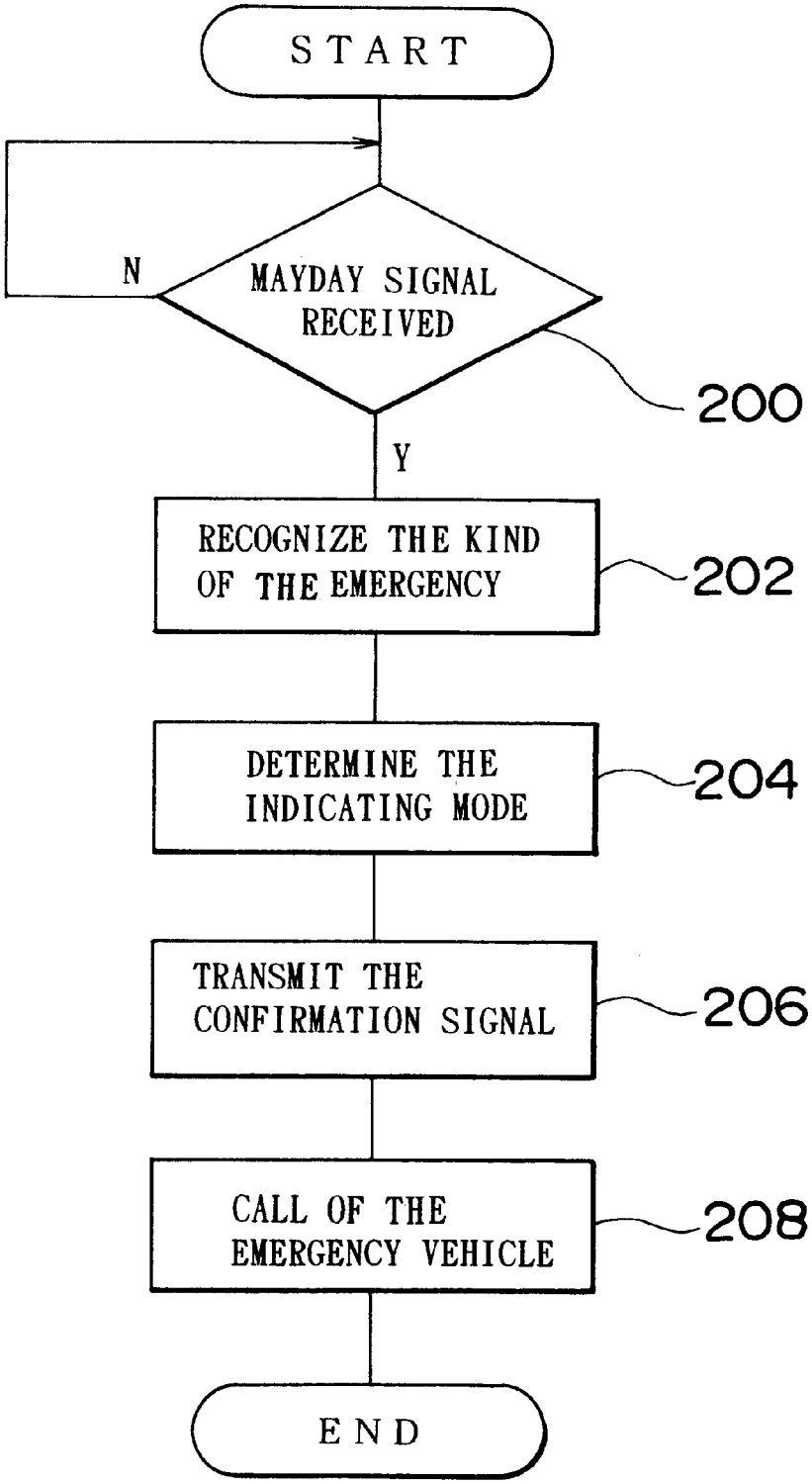
FIG. 4 is a flow chart setting forth the operational program in the control center.

The control operation of the vehicle navigation system 10 is described below with reference to the flow charts shown in FIG. 3 and FIG. 4. When the driver starts the vehicle by use of the ignition key, the flow chart shown in FIG. 3 is executed in the navigation system 10. In step 100, it is determined whether the air bag system 48 has been operated based on the output signal of the air bag system 48. In step 100, it is also possible to determine whether the vehicle is under water based on the output signal from the underwater detecting device 50. It is then possible to judge the driver's situation based on at least the output signal from the air bag system 48 and/or the underwater detecting device 50.

If it is determined in step 100 that the air bag system 48 has been operated or that the vehicle is under water, it is considered that an emergency situation exists and the flow chart proceeds to step 120. In step 120, the mayday media terminal device 34 automatically transmits an emergency signal that includes information about the driver's situation to the control center 70 or other remote location and the flow proceeds to step 114. It is desirable to transmit with the emergency signal data identifying the position or location of the vehicle and identification data identifying the vehicle. It may also be desirable to add to a cancel button (not illustrated in FIG. 1) to the navigation system so that when the cancel button is operated, the emergency signal regarding the driver's situation is cancelled and is not transmitted to the control center 70.

On the other hand, if it is determined in step 100 that the air bag has not been operated and an underwater situation does not exist, the flow proceeds to step 102. At step 102, it is determined whether the sensor on the driver seat or the passenger seat has been activated based on the output signal of the seat sensor 56. If the determination in step 102 is NO, the flow proceeds to step 104. Step 104 is executed to diagnose the condition of the seat sensor 56 because if the seat sensor 56 fails, it is desirable to provide information regarding failure of the seat sensor 56. It is possible to provide an indication inside the vehicle, for example by turning on an indicator or generating a voice caution signal. It is also possible to automatically inform the control center 70 of the failure of the seat sensor 56 by using the mayday media terminal device 34. After completion of the seat sensor diagnosis, the operation finishes.

If the result of the determination in step 102 is YES, the flow proceeds to step 104, and it is judged whether or not the door knob switch 54 has been turned on. If the door knob switch 54 has not been turned on, the vehicle is judged to be in the normal driving situation. Therefore, in such a case, the determination in step 106 is NO and the operation finishes.

If it is determined in step 106 that the door knob switch 54 has been turned on, this provides an indication that someone has pulled the outside door knob. In such a situation, the program proceeds to step 108 at which a picture is taken inside the vehicle by the detecting inside sensor 52.

In step 110, it is then determined whether or not the sending button 44 has been pushed. If the sending button 44 has been pushed by the driver or another individual, an emergency signal is transmitted through the mayday media terminal unit 34. In this situation, step 112 is executed to transmit an emergency signal with the image data acquired in step 108 to the control center 70. Along with the emergency signal, it is also desirable to transmit position data identifying the position or location of the vehicle and identification data identifying the vehicle. Therefore, it is possible to recognize or identify the person and/or the position of the vehicle. If the determination in step 110 is NO, thus indicating that the sending button 44 has not been operated, step 110 is repetitively executed until it is determined that the sending button 44 has been operated.

After completion of step 112, the routine proceeds to step 114 where it is determined whether the signal receipt confirmation signal transmitted by the control center 70 or other remote location has been received by the mayday media terminal device 34. Until the determination in step 114 results in YES, step 114 is repeatedly executed. Once the mayday media terminal device 34 has received the signal receipt confirmation signal, the program proceeds to step 115.

Step 115 is executed to obtain information about the indicating mode from the received signal, and the program then proceeds to step 116. In step 115, the flag K is set to H or L based on the indicating mode of the signal receipt confirmation signal received from the control center 70. The flag K is set to H when the indicating mode is the noticeable mode (i.e., the mode in which the signal receipt confirmation indication is to be easily observed) and the flag K is set to L when the indicating mode is the unnoticeable mode (i.e., the mode in which the signal receipt confirmation indication is not to be readily visible and is indicated on, for example, the visually obscured small light 62). The flag K can be initially set at L and is not changed if the indicating mode does not differ from the current setting for the flag K. This indicating mode can be set based on the signal that is received from the mayday media terminal device 34. For example, the signal transmitted by the mayday media terminal device can include information indicating that the nature of the emergency situation requires the unnoticeable signal receipt confirmation indication or the noticeable signal receipt confirmation indication.

In step 116, it is determined whether the flag K is equal to H, i.e. whether the indicating mode is set to the more noticeable mode. When the flag K is set to H, the indicating mode is selected to be the more noticeable mode in step 118. In contrast, when the flag K is not equal to H, the indicating mode is selected to be the less noticeable or unnoticeable mode in step 122. In step 124 it is judged whether the indicating mode is selected for the more noticeable mode. If the selected indicating mode is the more noticeable mode, an easily noticeable signal receipt confirmation indication is outputted at step 126 so that the driver is noticeably informed of receipt of the emergency signal in step 126 in one of the ways discussed below. On the other hand, if the selected indicating mode is not the more noticeable mode, a less noticeable signal receipt confirmation indication is output at step 128 so that the driver is informed by one of the less noticeable indications mentioned below that the emergency signal has been received.

Figure 5A:
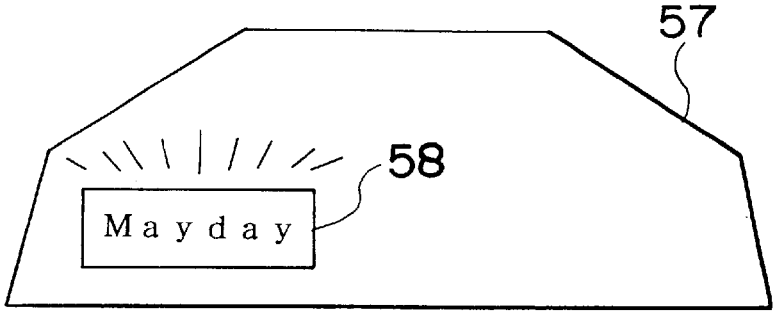
FIGS. 5A–5C show examples of more signal receipt confirmation indications.
Figure 5B:
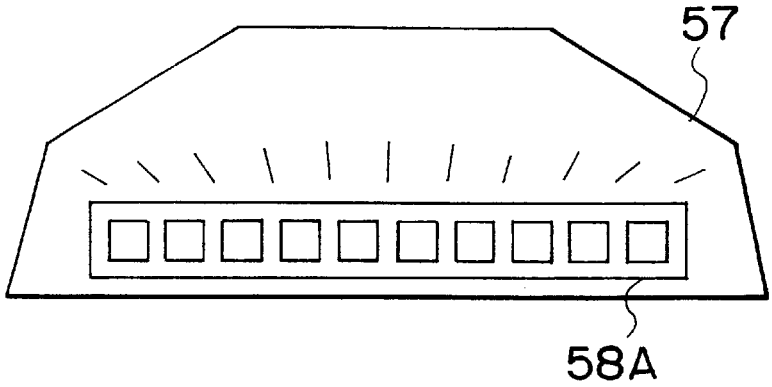
Figure 5C:
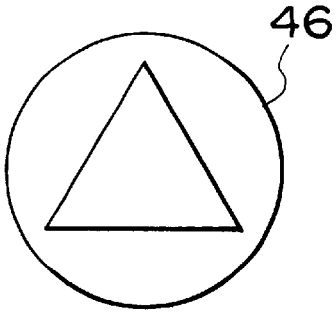

Examples of the above-mentioned more noticeable mode indications include consecutively turning a part of an indicator 58 in the instrument panel 57 on and off as seen in FIG. 5A, consecutively turning on and off all of the indicators 58A in the instrument panel 57 as shown in FIG. 5B and turning the hazard light on and off as illustrated in FIG. 5C. These are all ways of providing a very noticeable signal receipt confirmation indication to the driver indicating that the emergency signal has been received by the control center 70.

Figure 7:
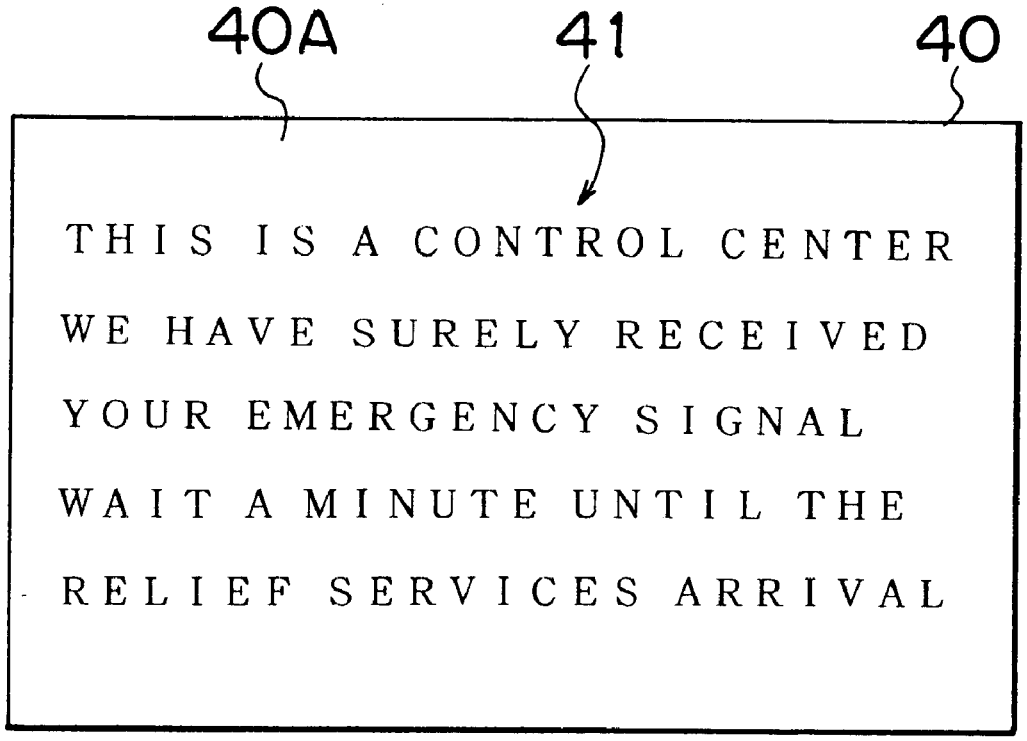
FIG. 7 shows an example of another more noticeable signal receipt confirmation indication.

According to FIG. 7, another example of the more easily noticeable mode indication involves displaying a message 41 such as: "This is a control center. We have surely received your emergency signal. Wait a minute until the relief service's arrival." This message can be displayed in the same vehicle display 40 which informs the driver of subsidiary route information. In such a case, it is also effective to turn the background 40A of the vehicle display 40 on and off consecutively. While the displayed message can be fixed in nature, it can also be varied depending upon the nature of the emergency signal. Also, it is possible to audibly inform the driver through use of the speaker unit 38 that the emergency signal has been received.

Figure 6A:
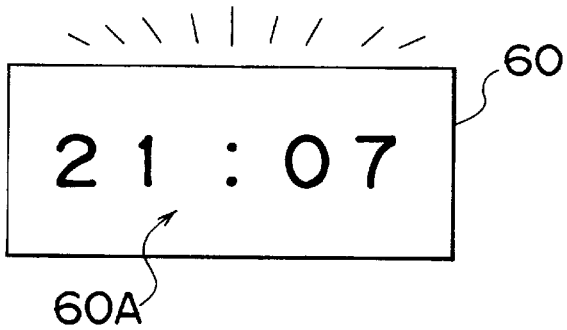
FIGS. 6A–6C show examples of less noticeable signal receipt confirmation indications.
Figure 6B:
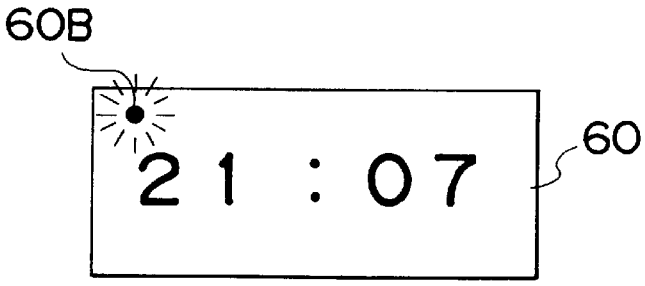
Figure 6C:
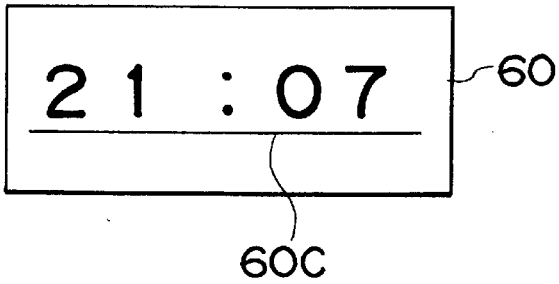

The less noticeable mode indication can be embodied in a variety of different forms including turning on and off the small light 62 shown in FIG. 2, turning on and off the indicator of the time display 60A in the liquid crystal indicator 60 as shown in FIG. 6A, turning on and off the mark 60B in the liquid crystal indicator 60 as shown in FIG. 6B, and adding an underline 60C to the liquid crystal indicator 40 or turning such underline 60C on and off as shown in FIG. 6C.

Other examples of the less noticeable mode indication include vibrating the driver's seat or the passenger's seats through operation of the seat vibration motor 64, automatically folding the door mirror, or automatically stopping operation of the wiper during wiper operation.

The following is a description of the operation that occurs in the control center 70. This operation is shown in FIG. 4 and involves first determining in step 200 whether the control center 70 has received the emergency or mayday signal from the vehicle or other location. If the control center 70 has not received the emergency signal yet, step 200 is repeatedly executed. On the other hand, when the control center 70 has received the emergency signal, the program proceeds to step 202. In step 202, the control center 70 recognizes the kind or type of emergency signal that has been sent. In this step, information about the driver's situation is extracted from the emergency signal transmitted from the vehicle. According to this information, it is determined whether and what kind of relief service is required.

If image data is included in the emergency signal, the OP (operator) is able to recognize the vehicle situation by watching the displayed image. The OP is thus able to recognize, for example, that a robber has entered the vehicle or that the driver is trying to fight off the robber. It is desirable to recognize the driver's action in various situations, for example when the output signal of the seat sensor 56 changes.

After the execution of step 202, the indicating mode is determined in step 204. That is, a decision is made whether the signal receipt confirmation signal sent by the control center should be displayed as a more noticeable signal receipt confirmation indication or a less noticeable signal receipt confirmation indication. This can be accomplished by an operator at the control center who includes with the signal receipt confirmation signal appropriate indicating mode information (e.g., information to set the flag K to H or L). It is also possible that the system could be designed so that at the time the emergency signal is transmitted by the transmitter, the flag K is set to the appropriate value to designate the indicating mode (i.e., the noticeable indicating mode or the unnoticeable indicating mode) that the signal receipt confirmation signal subsequently sent by the control center. In the following step 206, the signal receipt confirmation signal indicating receipt of the emergency signal by the control center 70, and including indicating mode information (i.e., the more noticeable indicating mode or the less noticeable indicating mode), is transmitted to the mayday media terminal device 34. Thus, the signal receipt confirmation signal includes information concerning whether the flag K is set to H or L and information indicating that the emergency signal has been received. In step 208, the control center 70 performs other predetermined operations on the basis of the received emergency signal. That is, the control center 70 can, for example, call an emergency vehicle or notify a security service.

By virtue of the present invention, it is possible to select the more noticeable indicating mode or the less noticeable indicating mode to inform the driver or other individual that the control center has received the emergency signal. Therefore, it is possible to change the indicating mode sent by the control center 70 based on the emergency signal transmitted from the vehicle and so it is possible to select the indicating mode on the basis of the situation of the driver or other individual. For example, when the driver becomes sick or meets with an accident, the more noticeable indicating mode is determined and so the user is easily able to recognize or see the signal receipt confirmation signal. On the other hand, when the user encounters a robber, the less noticeable indicating mode is selected and so it is possible for the user to recognize or observe the signal receipt confirmation signal without the robber also being able to see such signal.

As described above a receipt confirmation message can be displayed in the vehicular display 40. However, a predetermined mark or figure may be displayed instead.

When the inside detecting sensor 52 detects the robber's entry inside the vehicle, the swing of the suspension device can be useful to detect the robber's entry.

In the above mentioned embodiment, the indicating mode is determined to be either the more noticeable mode or the less noticeable mode. However, the indicating mode can also be determined out of more than two indicating modes.

In the above mentioned embodiment, when the encounters the robber, the less noticeable mode is determined. However, when the user does not exist in the vehicle, the noticeable mode can be determined to threat the robber inside the vehicle.

By virtue of the present invention, it is possible to receive confirmation from the control center or other remote location that the transmitted emergency signal has been received. Moreover, the signal receipt confirmation signal that is sent by the control center is specifically designed to be appropriate for the emergency situation. Thus, the transmitter in the vehicle transmits an emergency signal to the control center or other location when an emergency situation arises. The transmitted signal is accompanied by a signal indicating the driver's situation. The control center receives the emergency signal and the operator is able to determine the nature of the emergency situation so as to determine the type of signal receipt confirmation signal that should be sent back to the vehicle to provide an indication that the emergency signal has been received by the control center. For example, if the emergency situation is one involving, for example, a robbery, the emergency signal is transmitted with a picture of the inside vehicle taken by the detecting inside sensor 52. The emergency signal in this way is thus accompanied by a situation detecting signal that detects the existing situation in the vehicle. The operator at the control center can then send a signal receipt confirmation signal back to the vehicle that includes both signal receipt confirmation information indicating receipt of the emergency signal as well as indicating mode information identifying the nature of the signal receipt confirmation indication that is to be displayed in the vehicle. As noted above, in the case of an emergency situation involving a robbery, the indicating mode information would be the less noticeable indication so that the driver can view the signal receipt confirmation information while at the same time making it difficult for the robber to view the signal receipt confirmation indication. That is, the driver would know where to look for the signal receipt confirmation indication whereas the robber would not. On the other hand, if the emergency situation is not one involving, for example, a robbery, but rather one arising because of, for example, an accident (i.e., the air bag has been operated or the underwater detection device has been activated), the signal receipt confirmation signal sent by the control center to the vehicle would include indicating mode information identifying the more noticeable confirmation indication. In such a situation, the more noticeable signal receipt confirmation indication would be actuated in the vehicle to let the driver or other individual know that the emergency signal has been received by the control center.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A transmitted signal confirmation device comprising:

a transmitter for transmitting a signal from a location at which exists a situation;

a receiver for receiving a signal receipt confirmation signal transmitted by a facility outside said location indicating that the facility has received said signal transmitted by the transmitter;

indicating mode determining means for determining, based on the situation existing at the location, one indicating mode out of at least two different indicating modes upon receipt of the signal receipt confirmation signal by the receiver so that a first indicating mode is determined when the situation existing at the location is one situation and a second indicating mode different from the first indicating mode is determined when the situation existing at the location is a situation different from said one situation;

an indicator for outputting, in the indicating mode determined by the indicating mode determining means, a signal receipt confirmation indication providing an indication that the signal transmitted by the transmitter has been received by the facility.

2. A transmitted signal confirmation device according to claim 1, including situation detecting means for detecting the situation existing at the location.

3. A transmitted signal confirmation device according to claim 2, wherein said indicator provides a first signal receipt confirmation indication which is noticeable and a second signal receipt confirmation indication which is less noticeable than said first signal receipt confirmation indication.

4. A transmitted signal confirmation device according to claim 1, wherein said indicator provides a first signal receipt confirmation indication which is noticeable and a second signal receipt confirmation indication which is less noticeable than said first signal receipt confirmation indication.

5. A transmitted signal confirmation device according to claim 3, wherein said situation detecting means provides information to the facility indicating the existence of a situation at the location in which an individual at the location wants to be able to readily observe the signal receipt confirmation indication, said indicating mode determining means determining said first indicating mode when said situation detecting means provides information to the facility indicating that the individual at the location wants to readily observe the signal receipt confirmation indication.

6. A transmitted signal confirmation device according to claim 2, wherein said signal transmitted by the transmitter includes a situation signal provided by said situation detecting means.

7. A transmitted signal confirmation device according to claim 6, wherein the signal receipt confirmation signal from said facility includes indicating mode information, and said indicating mode determining means determines the indicating mode based on the indicating mode information included in the signal receipt confirmation signal.

8. A transmitted signal confirmation device according to claim 7, wherein said indicating mode information included in the signal receipt confirmation signal is based on the situation signal provided by said situation detecting means.

9. A transmitted signal confirmation device comprising:

a transmitter for transmitting a signal from a location;

a receiver for receiving a signal receipt confirmation signal transmitted by a facility outside the location indicating that the facility has received said signal transmitted by the transmitter;

situation detecting means for detecting a situation existing at said location;

indicating mode determining means for determining one indicating mode from at least two different indicating modes based on the situation existing at the location as detected by said situation detecting means so that a first indicating mode is determined when the situation existing at the location is one situation and a second indicating mode different from the first indicating mode is determined when the situation existing at the location is a situation different from said one situation; and an indicator for providing a signal receipt confirmation indication with said one indicating mode when said receiver has received the signal receipt confirmation signal.

10. A transmitted signal confirmation device according to claim 9, wherein said indicator provides a first signal receipt confirmation indication which is noticeable and a second signal receipt confirmation indication which is less noticeable than said first signal receipt confirmation indication.

11. A transmitted signal confirmation device according to claim 10, wherein said situation detecting means provides information to the facility indicating whether an individual at the location wants to be able to readily observe the signal receipt confirmation indication, said indicating mode determining means determining said first indicating mode when said situation detecting means provides information to the facility indicating that the individual at the location wants to readily observe the signal receipt confirmation indication.

12. A transmitted signal confirmation device according to claim 9, wherein said signal transmitted by the transmitter includes situation information detected by said situation detecting means.

13. A transmitted signal confirmation device according to claim 12, wherein the signal receipt confirmation signal from said facility includes indicating mode information, and said indicating mode determining means determines the indicating mode based on the indicating mode information included in the signal receipt confirmation signal.

14. A transmitted signal confirmation device according to claim 13, wherein said indicating mode information included in the signal receipt confirmation signal is based on the situation information provided by said situation detecting means.

15. A method of confirming receipt of a transmitted signal, comprising:

transmitting a signal from a location at which exists a situation;

receiving a signal receipt confirmation signal indicating that a facility outside the location has received the transmittal signal;

selecting one indicating mode out of at least two different indicating modes based on the situation existing at the location so that a first indicating mode is selected when the situation existing at the location is one situation and a second indicating mode different from the first indicating mode is selected when the situation existing at the location is a situation different from said one situation; and providing a signal receipt confirmation indication in said one indicating mode.

16. A method of confirming a transmitted signal according to claim 15, wherein said selection of the one indicating mode includes selecting either the first indicating mode which provides a first signal receipt confirmation indication or the second indicating mode which provides a second signal receipt confirmation indication that is less noticeable than the first signal receipt confirmation indication.

17. A method of confirming a transmitted signal according to claim 16, including determining whether an individual at the location wants to readily notice the signal receipt confirmation indication, said first indicating mode being selected when it is determined that the individual at the location wants to readily notice the signal receipt confirmation indication.

18. A method of confirming a transmitted signal according to claim 15, wherein said transmitting of the signal includes transmitting a signal indicating a situation existing at the location.

19. A method of confirming a transmitted signal according to claim 18, wherein said step of receiving a signal receipt confirmation signal includes receiving indicating mode information, and said step of selecting one indicating mode includes selecting an indicating mode based on the indicating mode information.

20. A method of confirming a transmitted signal according to claim 19, wherein said indicating mode information is based on the signal indicating the situation existing at the location.

21. A transmitted signal confirmation device comprising:

a transmitter for transmitting a signal from a location at which exists a situation;

a receiver for receiving a signal receipt confirmation signal transmitted by a facility outside said location indicating that the facility has received said signal transmitted by the transmitter;

indicating mode determining means for determining, upon receipt of the signal receipt confirmation signal by the receiver, one indicating mode out of at least first and second different indicating modes, the indicating mode determining means determining the first indicating mode when the situation existing at the location is one situation and determining the second indicating mode when the situation existing at the location is a situation different from said one situation;

an indicator for outputting, based on the indicating mode determined by the indicating mode determining means, a signal receipt confirmation indication providing an indication that the signal transmitted by the transmitter has been received by the facility, said indicator outputting a first noticeable signal receipt confirmation indication when the first indicating mode is determined by the indicating mode determining means and outputting a second signal receipt confirmation indication that is less noticeable than said first signal receipt confirmation indication when the second indicating mode is determined by the indicating mode determining means.

22. A transmitted signal confirmation device comprising:

a transmitter for transmitting a signal from a location at which exists a situation;

a receiver for receiving a signal receipt confirmation signal transmitted by a facility outside the location indicating that the facility has received said signal transmitted by the transmitter;

situation detecting means for providing information concerning a situation existing at said location;

indicating mode determining means for determining, based on the situation existing at the location as detected by said situation detecting means, one of at least a first indicating mode and a second indicating mode that are different from one another, with the first indicating mode being determined when the situation existing at the location is one situation and the second indicating mode being determined when the situation existing at the location is a situation different from said one situation; and an indicator which outputs, when said receiver has received the signal receipt confirmation signal, a first noticeable signal receipt confirmation indication when said indicating mode determining means determines said first indicating mode and a second signal receipt confirmation indication that is less noticeable than said first signal receipt confirmation indication when said indicating mode determining means determines said second indicating mode.

23. The transmitted signal confirmation device according to claim 22, wherein the transmitter transmits the signal from the location of a vehicle, and wherein said indicating mode determining means determines the first indicating mode when said situation detecting means provides information indicating that an individual in the vehicle is sick or has been involved in an accident.

24. The transmitted signal confirmation device according to claim 22, wherein the transmitter transmits the signal from the location of a vehicle, and wherein said indicating mode determining means determines the second indicating mode when said situation detecting means provides information indicating that an individual in the vehicle has encountered a robber.

25. The transmitted signal confirmation device according to claim 22, wherein the transmitter transmits the signal from the location of a vehicle, and wherein said first signal receipt confirmation indication includes one of a displayed message in the vehicle, a flashing display in the vehicle, and an emitted sound.

26. The transmitted signal confirmation device according to claim 22, wherein the transmitter transmits the signal from the location of a vehicle, and wherein said second signal receipt confirmation indication includes one of turning on and off a light in the vehicle, turning on and off a portion of a display in the vehicle, displaying a sign on a display in the vehicle.

* * * * *